US010653910B2

(12) United States Patent
Da Costa et al.

(10) Patent No.: US 10,653,910 B2
(45) Date of Patent: May 19, 2020

(54) FIRE FIGHTING FOAMING COMPOSITIONS

(71) Applicant: Angus Holdings Safety Group Limited, Bentham, Lancashire (GB)

(72) Inventors: Joel Da Costa, Bamber Bridge (GB); John McCabe, Bentham (GB)

(73) Assignee: Angus Holdings Safety Group Limited, Bentham, Lancashire (GB)

( * ) Notice: Subject to any disclaimer, the term of this patent is extended or adjusted under 35 U.S.C. 154(b) by 3 days.

(21) Appl. No.: 15/525,829

(22) PCT Filed: Nov. 13, 2015

(86) PCT No.: PCT/GB2015/053451
§ 371 (c)(1),
(2) Date: May 10, 2017

(87) PCT Pub. No.: WO2016/075480
PCT Pub. Date: May 19, 2016

(65) Prior Publication Data

US 2017/0368395 A1 Dec. 28, 2017

(30) Foreign Application Priority Data

Nov. 14, 2014 (GB) ..... 1420251.9

(51) Int. Cl.
*A62D 1/02* (2006.01)

(52) U.S. Cl.
CPC ..... *A62D 1/0071* (2013.01)

(58) Field of Classification Search
CPC ..... A62D 1/0071
See application file for complete search history.

(56) References Cited

U.S. PATENT DOCUMENTS

| | | | | |
|---|---|---|---|---|
| 4,681,704 | A | 7/1987 | Bernardino et al. | |
| 5,238,609 | A * | 8/1993 | Smith | A61K 8/40 510/125 |
| 2003/0078180 | A1* | 4/2003 | Munoz, Jr. | C11D 1/29 510/407 |
| 2008/0010754 | A1* | 1/2008 | Bureiko | A61K 8/042 8/406 |
| 2008/0081023 | A1* | 4/2008 | Deckner | A61K 8/042 424/49 |
| 2009/0072182 | A1 | 3/2009 | Berger | |
| 2009/0088358 | A1* | 4/2009 | Roso | A61K 8/602 510/130 |

FOREIGN PATENT DOCUMENTS

| | | | |
|---|---|---|---|
| WO | WO9512433 | A1 | 5/1995 |
| WO | WO2014153154 | A1 | 9/2014 |

* cited by examiner

*Primary Examiner* — Andrew J. Oyer
(74) *Attorney, Agent, or Firm* — Michael J. Blessent; Bret E. Field; Bozicevic, Field & Francis LLP

(57) ABSTRACT

A fire fighting composition according to the invention comprises a first surfactant selected from alkyl group-containing amphoteric surfactants, wherein the alkyl group contains at least 8 carbon atoms, and alkyl group-containing zwitterionic surfactants, wherein the alkyl group contains at least 8 carbon atoms, and mixtures thereof, and a second surfactant selected from alkyl group-containing anionic surfactants, wherein the alkyl group contains at least 8 carbon atoms, and wherein the weight ratio of the first surfactant to the second surfactant is in the range of from 3:1 to 1:1.5, wherein the fire fighting foaming composition is essential free of fluorine. Typically, the first surfactant is selected from alkyl amine oxides, betaines and N-alkyl pyrrolidones. Typically, the second surfactant is selected from alkyl sulphates, alkyl phosphates, dialkylsulphosuccinates, sodium alkyl ether sulphates and alkyl carboxylates. The compositions which are essentially-free of fluorine or fluorine-containing compounds give a good combination of fire fighting properties, such as burn back performance and extinguishing capability.

23 Claims, No Drawings

FIRE FIGHTING FOAMING COMPOSITIONS

The present invention relates to fire fighting foaming compositions. More particularly, the invention relates to aqueous foaming compositions which are essentially free of fluorine.

Fires involving flammable liquids are commonly cooled and extinguished by the use of foams. The foam used must be capable of cooling the fire and of coating the fuel, preventing its contact with oxygen and, thus, suppressing combustion.

Aqueous compositions containing one or more surfactants, known as foaming compositions, are available as concentrates for dilution and foaming to produce a foam that can be used to extinguish or control a fire. The ability of a foam to prevent resurgence of the fire is known as its 'burn-back performance'. Thus, any foaming composition useful in combating fires must be capable of producing a foam that has good burn-back performance.

Many effective foaming compositions comprise fluorine-containing surfactants. However, the use of such materials causes problems as a result of the longevity of fluorinated products and the potential implications concerning the environment.

It is an object of the present invention to provide fire fighting foaming compositions that produce foams that have a combination of good burn-back performance and good extinguishing capability while not having the potential environmental impact of fluorochemical foams.

In accordance with a first aspect, the present invention provides a fire fighting foaming composition comprising a first surfactant selected from alkyl group-containing amphoteric surfactants, wherein the alkyl group contains at least 8 carbon atoms, and alkyl group-containing zwitterionic surfactants, wherein the alkyl group contains at least 8 carbon atoms, and mixtures thereof, and a second surfactant selected from alkyl group-containing anionic surfactants, wherein the alkyl group contains at least 8 carbon atoms, and wherein the weight ratio of the first surfactant to the second surfactant is in the range of from 3:1 to 1:1.5, and wherein the said fire fighting foaming composition is essentially free of fluorine.

In accordance with a second aspect, the present invention provides the use of a fire fighting foaming composition comprising a first surfactant selected from alkyl group-containing amphoteric surfactants, wherein the alkyl group contains at least 8 carbon atoms, and alkyl group-containing zwitterionic surfactants, wherein the alkyl group contains at least 8 carbon atoms, and mixtures thereof, and a second surfactant selected from alkyl group-containing anionic surfactants, wherein the alkyl group contains at least 8 carbon atoms, and wherein the weight ratio of the first surfactant to the second surfactant is in the range of from 3:1 to 1:1.5, and wherein the fire fighting foaming composition is essentially free of fluorine, in the preparation of a composition for application to a fire.

The fire fighting foaming composition of the present invention is an aqueous system. In one embodiment, the composition contains, in addition to water, at least one water-miscible organic solvent. Examples of suitable water-miscible solvents for use in the invention include glycols, glycol ethers and 1-8C alkanols.

The term "fire fighting foaming composition" as used herein is meant to cover compositions which can be aerated to form foams for application to fires and also concentrated compositions which require dilution before they can be foamed and applied to fires.

The compositions of the present invention are, as stated above, essentially free of fluorine. By the term "essentially free of fluorine" we mean that the compositions of the invention are free of added fluorine or fluorine-containing compounds. Thus, although water or components of the compositions of the invention might contain fluorine or a fluorine-containing compound as an impurity and/or contaminant, no fluorine or fluorine-containing compounds are deliberately added to, or incorporated in, the compositions by design. In particular, the compositions of the invention are essentially free of fluorine-containing surfactants or other organic fluorine compounds.

The compositions of the invention comprise a first surfactant selected from alkyl group-containing amphoteric surfactants wherein the alkyl group contains at least 8 carbon atoms, alkyl group-containing zwitterionic surfactants wherein the alkyl group contains at least 8 carbon atoms, and mixtures thereof. The chain length of the alkyl group is selected to ensure that the surfactant is suitable for use in fire fighting foaming compositions. Alkyl chain lengths of less than 8 carbon atoms are likely to result in surfactants that may not have the required surface active properties. Alkyl chain lengths that are too great, for example greater than about 20 carbon atoms, are likely to result in surfactants that are not readily soluble or stable in a hydrophilic medium. Typically, the alkyl group of the amphoteric surfactant and the alkyl group of the zwitterionic surfactant each contains 10 or more carbon atoms, preferably 12 or more carbon atoms and typically contains not more than 16 carbon atoms and preferably not more than 14 carbon atoms, the amphoteric and/or zwitterionic surfactants may be present in the composition as a mixture of compounds having different alkyl chain lengths. The alkyl group of the alkyl group-containing amphoteric surfactant and the alkyl group of the alkyl group-containing zwitterionic surfactant may each be a straight chain alkyl group or a branched chain alkyl group. Straight chain alkyl groups are preferred, however.

Preferred examples of compounds that act as zwitterionic surfactants for use in the present invention include alkyl amine oxides wherein the alkyl group contains at least 8 carbon atoms, preferably 10 or more carbon atoms, more preferably 10 to 16 carbon atoms, especially 12 to 14 carbon atoms, wherein the alkyl group may be a straight chain or a branched chain alkyl group, preferably a straight chain alkyl group. The alkyl amine oxide may be a mixture of alkyl amine oxides having different alkyl chain lengths. Examples of alkyl amine oxides that may be used in the composition of the present invention include dimethyloctyl amine oxide, diethyldecyl amine oxide, dodecyl amine oxide, and dimethyldodecyl amine oxide. Of these, dimethyl dodecyl amine oxide is preferred.

Preferred examples of compounds that act as amphoteric surfactants for use in the present invention include betaines, sulphobetaines and hydroxysultaines containing an alkyl group having at least 8 carbon atoms. Betaines for use in the present invention typically contain a positively-charged amino group, to which is attached the alkyl group, and a negatively-charged carboxylic acid group. Typically, the alkyl group contains 10 or more carbon atoms, more preferably 10 to 16 carbon atoms, especially from 12 to 14 carbon atoms. The betaine may be a mixture of betaines having different alkyl chain lengths. The alkyl group may be a straight chain alkyl group or a branched chain alkyl group, although straight chain alkyl groups are preferred. Examples of betaines that may be used in the composition of the present invention include cocoamidopropyl betaine.

Examples of other amphoteric surfactants that can be used in the present invention include N-alkylated-2-pyrollidones such as those containing 8-12C alkyl groups.

The fire fighting foaming composition of the invention also comprises a second surfactant selected from alkyl group-containing anionic surfactants and mixtures of two or more of these, wherein the alkyl group contains at least 8 carbon atoms. The chain length of the alkyl group is selected to ensure that is the surfactant is suitable for use in fire fighting foaming compositions. Alkyl chain lengths of less than 8 carbon atoms are likely to result in surfactants that may not have the required surface active properties. Alkyl chain lengths that are too great, for example greater than about 20 carbon atoms, are likely to result in surfactants that are not readily soluble or stable in a hydrophilic medium. Typically, the alkyl group will contain 10 or more carbon atoms, preferably 12 or more carbon atoms, typically not more than 16 carbon atoms, preferably not more than 14 carbon atoms. Any anionic surfactant may be used as a mixture of anionic surfactants having different alkyl chain lengths. The alkyl group of the alkyl group-containing anionic surfactant may be a straight chain alkyl group or a branched chain alkyl group, with straight chain alkyl groups being preferred. Examples of anionic surfactants that may be used in the composition of the invention include alkyl sulphates, alkyl phosphates, dialkylsulphosuccinates, alkyl ether sulphates, alkyl carboxylates and mixtures of two or more of these, wherein, in each case, the alkyl group may be a straight chain or branched chain alkyl group, preferably a straight chain alkyl group, and will typically contain 10 or more carbon atoms, preferably 10 to 16 carbon atoms and more preferably 12 to 14 carbon atoms. Each of these compounds may be used as a mixture containing different alkyl chain lengths.

Preferred anionic surfactant for use in the compositions are 10 to 16C alkyl sulphates, especially 12 to 14C alkyl sulphates. The alkyl sulphates may be ammonium, alkali metal salts or alkaline earth metal salts, preferably sodium salts, or alkaline earth metal salts, for example magnesium salts.

Examples of compounds that may be used in the compositions of the invention as anionic surfactants include mixed 12-16C alkyl sulphate ammonium salt, mixed 10-12C alkyl sulphate sodium salt, dodecyl sulphate sodium salt, dialkyl sulphosuccinates, 10-16C alkyl carboxylates, 10-16C alkyl sulphonates and alkyl $(OCH_2CH_2)_n$ sulphate sodium salt, where n=2 or 3.

According to the invention, the weight ratio of the first surfactant to the second surfactant in the composition is in the range of 3:1 to 1:1.5, preferably from 2.5:1 to 1:1.2, more preferably from 2.2:1 to 1:1.2.

According to one preferred embodiment of the invention, the composition comprises, as first surfactant, an alkylamine oxide and, as second surfactant, an alkyl sulphate, wherein the weight ratio of alkylamine oxide to alkyl sulphate is about 2:1.

According to a different preferred embodiment, the composition comprises, as first surfactant, an alkylamine oxide and, as second surfactant, an alkyl sulphate, wherein the weight ratio of alkylamine oxide to alkyl sulphate is about 1:1.

As mentioned above, the compositions of the invention contain water. Typically, water is present in the composition in an amount of from 22 to 88% (w/w).

The composition of the invention additionally comprises at least one water-miscible organic solvent, such as one or more glycols, glycol ethers and 1-8C alkanols. Examples of compounds that may be used in the compositions as water-miscible organic solvents include hexylene glycol, 2-(2-butoxyethoxy) ethanol and diethylene glycol. Typically, the water-miscible organic solvent, when used, will be present in the composition in an amount of from 5 to 30% (w/w).

According to an embodiment, the composition of the invention comprises dodecylsulphate sodium salt about 24% (w/w)
dimethyl dodecyl amine oxide about 24% (w/w)
and about 30% (w/w) of a solvent selected from glycols and glycol ethers.

According to another embodiment, the composition of the invention comprises dodecylsulphate sodium salt about 8% (w/w)
dimethyl dodecyl amine oxide about 8% (w/w)
and about 10% (w/w) of a solvent selected from glycols and glycol ethers.

According to a different embodiment, the composition of the invention comprises dodecylsulphate sodium salt about 4% (w/w)
dimethyl dodecyl amine oxide about 4% (w/w)
and about 5% (w/w) of a solvent selected from glycols and glycol ethers.

In a further embodiment, the composition of the invention comprises dodecylsulphate sodium salt about 16% (w/w)
dimethyl dodecyl amine oxide about 32% (w/w)
and about 30% (w/w) of a solvent selected from glycols and glycol ethers.

In a yet further embodiment, the composition of the invention comprises dodecylsulphate sodium salt about 5.3% (w/w)
dimethyl dodecyl amine oxide about 10.7% (w/w)
and about 10% (w/w) of a solvent selected from glycols and glycol ethers.

In a yet further, different, embodiment, the composition of the invention comprises dodecylsulphate sodium salt about 2.7% (w/w)
dimethyl dodecyl amine oxide about 5.3% (w/w)
and about 5% (w/w) of a solvent selected from glycols and glycol ethers.

The composition of the invention may contain one or more additives conventionally used in fire fighting foaming compositions. Such additives may, for instance, be one or more of corrosion inhibitors, divalent metal salts, buffers—for instance to control pH, stabilisers and anti-freeze agents. According to one preferred embodiment, the composition will contain one or more corrosion inhibitors.

According to an embodiment, salts of calcium or magnesium are included in the composition of the invention to improve performance in soft waters.

Although typically the compositions of the present invention are Newtonian fluids, it is possible to include one or more polysaccharide gums and/or thickeners in the compositions. The incorporation of these substances may have the effect that the composition is a non-Newtonian fluid. In such a case, the person skilled in the art is aware of the effect the presence of such substances may have on the viscosity of the composition. Preferably, the compositions of the invention do not contain polysaccharide gums and, if the presence of a thickening agent is desired in the composition of the invention, the thickening agent is preferably one that does not comprise any polymerised sugars or polysaccharide gum. More preferably, the compositions will not contain any polysaccharides.

The fire fighting foaming compositions can be batch mixed in conventional fire fighting tanks or can be added into a water stream using conventional metering equipment. Foaming can be achieved using foaming procedures conventional in the production of fire fighting foams.

The foaming compositions of the invention are useful for cooling and suppressing or extinguishing fires resulting from the combustion of water-immiscible volatile flammable liquids such as liquid hydrocarbons, especially hexane, and aviation fuel mixtures, such as Avtur, Avgas and the like.

EXAMPLES

The compositions shown in the Tables below were prepared by simple mixing of the ingredients. Unless otherwise stated, the water used was fresh water. The compositions were evaluated for their extinction times and burn-back performance.

The evaluations were carried out according to the testing procedure described in British Standard EN 1568-3:2008 using Avtur (aviation kerosene) fires. Briefly, the testing procedure was as follows:

Apparatus

A circular fire tray of brass was used having an internal diameter (at rim) of about 565 mm, height (of vertical wall) of about 150 mm, height (of conical base) of about 30 mm and thickness of vertical wall of about 1.2 mm. The fire tray had a turned over rim and a drain point, with valve, at the centre of the conical base and had an area of about 0.25 $m^2$. The fire tray was supported approximately 1 m above the ground on a steel frame with four legs and placed beneath a suitable fume extraction hood to extract the smoke without interfering with the fire.

For the burn-back testing, a brass burn-back pot was used having an internal diameter (at rim) of about 120 mm, internal depth of about 80 mm and a wall thickness of about 1.2 mm. The pot had a turned over rim, and was fitted with four studs at the base to give an overall height of about 96 mm. A chain, fitted to the rim, allowed the pot to be lifted using a metal rod.

Foam making nozzle had a nominal flow rate of 5.01/min at 7 bar when tested with water. It was fitted with an adjustable collar to allow foam to be ejected from the side of the nozzle and thus vary the foam flow rate through the outlet. It was, also, possible to control the foam flow rate by adjusting the pressure applied to the foam solution.

Test Procedure

Test Conditions

The test was carried out under the following conditions:

a) air temperature (15±5)° C.;

b) fuel temperature (17.5±2.5)° C.;

c) foam solution temperature (17.5±2.5)° C.

Set Up

The foam nozzle was positioned horizontally with the by-pass holes in the adjustable collar facing downwards at a height of (150±5) mm above the rim of the fire tray.

The nozzle pressure was set to 7 bar and the foam flow rate to (0.75±0.025) kg/min by adjusting the collar and, if necessary reducing the nozzle pressure. It was convenient to collect the foam in a tared vessel for 6 s and to weigh it to calculate the flow rate.

The nozzle was positioned while keeping it horizontal so that the foam struck the centre of the fire tray. Shut off the foam discharge. Clean the tray and close the drain valve.

Fire Test (9±0.1)l of fuel were placed in the tray, and (0.3±0.01)l of fuel in the burn-back pot.

(120±2) s after fuelling the fuel was ignited and allowed to burn for (60±2) s before starting foam application. Foam was applied for (120±2) s to the centre of the tray and the times recorded from the start of foam application to 90% control, 99% control, and complete extinction.

At the end of foam application the fuel was ignited in the burn-back pot, and (60±2) s after the end of foam application the pot was lowered into the centre of the tray with a metal rod, taking care not to allow foam to enter the pot. The time taken from positioning of the burn-back pot to permanent full reinvolvement of the fire tray surface in flames was recorded as the burn-back time.

TABLE 1

| Example | 1 | 2 | 3 | 4 | 5 |
|---|---|---|---|---|---|
| C10 sulphate | | | | 2.4 | |
| C12 sulphate | 2.4 | 2.4 | | | 2.4 |
| C12-14 sulphate | | | | | |
| C12-16 sulphate | | | | | |
| C10 amine oxide | | | | | 2.4 |
| C12 amine oxide | 2.4 | | 2.4 | 2.4 | |
| C14 amine oxide | | | | | |
| Cocamidopropylamine oxide | .24 | | | | |
| Butyl carbitol | 10 | 10 | 10 | 10 | 10 |
| Water | to 100 | to 100 | to 100 | to 100 | to 100 |
| Extinction (min) | 1.23 | X | X | 2.10 | 1.55 |
| Burnback (min) | 9.00 | | | 4.50 | 3.30 |

TABLE 2

| Example | 6 | 7 | 8 | 9 | 10 | 11 | 12 |
|---|---|---|---|---|---|---|---|
| C10 sulphate | 2.4 | | | | | | |
| C12 sulphate | | 2.4 | 2.4 | | | | |
| C12-14 sulphate | | | | 2.4 | 2.4 | | |
| C12-16 sulphate | | | | | | 2.4 | 2.4 |
| C10 amine oxide | 2.4 | | | | | | |
| C12 amine oxide | | | 2.4 | 2.4 | | 2.4 | |
| C14 amine oxide | | 2.4 | | | 2.4 | | 2.4 |
| Coca | | | | | | | |
| Butyl carbitol | 10 | 10 | 10 | 10 | 10 | 10 | 10 |
| Water | to 100 | to 100 | to 100 | to 100 | to 100 | to 100 | to 100 |
| Extinction (min) | X | 1.35 | 1.23 | 1.24 | 1.37 | 1.32 | 1.42 |
| Burnback (min) | | 9.00 | 7.20 | 8.00 | 8.00 | 7.00 | 6.45 |

TABLE 3

| | 13 | 14 | 15 | 16 | 17 | 18 | 19 |
|---|---|---|---|---|---|---|---|
| C10-C12 sulphate | | | | 2.4 | | | |
| C12 sulphate | | | | | 2.4 | 2.4 | |
| C12 amine oxide | 2.4 | 2.4 | 2.4 | 2.4 | 2.4 | 2.4 | 2.4 |
| C12-14 Triethanolamine alkyl sulphate | 2.4 | | | | | | |
| C12-16 ammonium alkyl sulphate | | 2.4 | | | | | |
| Sodium lauryl ether | | 2.4 | | | | | |
| Dioctyl sulpho succinate | | | | | | 1 | 2.4 |
| Alkyl phosphate ester | | | | | 1 | | |
| Butyl carbitol | 10 | 10 | 10 | 10 | 10 | 10 | 10 |
| Water | to 100 | to 100 | to 100 | to 100 | to 100 | to 100 | to 100 |
| Extinction (min) | X | 1.55 | 1.52 | X | 1.33 | 1.35 | X |
| Burnback (min) | | 2.30 | 3.27 | | 5.17 | 5.15 | |

TABLE 4

| | 20 | 21 | 22 | 23 | 24 | 25 | 26 |
|---|---|---|---|---|---|---|---|
| C10 sulphate | 2.4 | | | | | | |
| C12 sulphate | | 2.4 | 2.4 | 2.4 | 2.4 | 2.4 | |
| C12-14 sulphate | | | | | | | 2.4 |
| Cocamidopropylbetaine | | 2.4 | 0.3 | | | | |
| Cap amine oxide | 2.7 | | | | | 2.4 | |
| Alkyl diMe betaine | | | | | 2.4 | | |
| C1012 amine oxide | | | | 2.4 | | | |
| C12 amine oxide | | | | | | | |
| C10 alkyl pyrollidone | | | | | | | 2.4 |
| Xanthan gum | | | | | | | |
| Butyl carbitol | 10 | 10 | 10 | 10 | 10 | 10 | 10 |
| Water | to 100 | to 100 | to 100 | to 100 | to 100 | to 100 | to 100 |
| Extinction (min) | X | X | 1.27 | X | 3.05 | X | X |
| Burnback (min) | | | 5.41 | | X | | |

Tables 1 and 2 show clearly that performance is reliant on the combination of a first surfactant and a second surfactant.

Tables 3 and 4, below, show the performance of compositions containing commercially available surfactants different from those used in the compositions of Tables 1 and 2.

Evaluation Using Formulations Diluted in Sea Water

All testing was done based on the Defence Standard simulated sea water which contains 27 g/L Sodium Chloride and 10 g/L Magnesium Sulphate, which is a close replication of sea water that can be approximated as: 27 g/L Sodium Chloride, 6.5 g/L Magnesium Sulphate 1.5 g/L miscellaneous ions.

The compositions described in Table 5 were prepared by simple mixing of the ingredients wherein the water used was the simulated sea water described above and evaluated using the procedure described above.

TABLE 5

| | 27 | 28 | 29 | 30 | 31 |
|---|---|---|---|---|---|
| C10 sulphate | | | | | |
| C12 sulphate | 1.6 | | 1.2 | 1.8 | 2.4 |
| C12-14 sulphate | | 1.6 | | | |
| Cocamidopropylbetaine | | | | | |
| Cap amine oxide | 0.3 | | | | |
| Alkyl diMe betaine | | | | | |
| C1012 amine oxide | | | | | |
| C12 amine oxide | 3.1 | 3.1 | 2.4 | 2.4 | 2.4 |
| C10 alkyl pyrollidone | | | | | |
| Butyl carbitol | 10 | 10 | 10 | 10 | 10 |
| Water | to 100 | to 100 | to 100 | to 100 | to 100 |

TABLE 5-continued

| | 27 | 28 | 29 | 30 | 31 |
|---|---|---|---|---|---|
| Extinction (min) | 1.31 | 1.22 | X | X | 1.42 |
| Burnback (min) | 5.15 | 5.45 | | | 3.30 |

Example 32

A composition according to the invention was formulated as follows:

| | % by weight |
|---|---|
| $C_{12}$ sulphate | 5.6 |
| $C_{12}$ amine oxide | 10.4 |
| Morpholine salt of octanoic and decanoic acids | 0.5 |
| Butyl carbitol (solvent) | 10.0 |
| Water | to 100 |

The formulation above was tested in the ICAO B test at 3% in fresh water on Jet A1 fuel. The ICAO test is a standard test, well known in the art. The fire test method for performance level A, B or C fire fighting foams is described in ICAO Doc. 9137-AN/898, Airport Services Manual (ASM), Part 1, Rescue and Fire Fighting, Chapter 8. The results for 99% control, 100% extinguishment and burn-back were:—

| | Standard | Example |
|---|---|---|
| 99% control | <60 s | 48 s (pass) |
| 100% extinguishment | <120 s | <120 s (pass) |
| Burn-back | >5 minutes | 6 minutes and 5 s (pass) |

It is known in the art that conventional foams containing fluorocarbon surfactants are able to lower surface tension sufficiently to give negative spreading energy on hydrocarbon fuels, i.e. they are able to form films on such fuels. Film forming properties are important since they allow the foam to spread over the surface of a burning fuel and thus cool it down and prevent the passage of oxygen to the fuel. This gives rapid control and extinguishment of the fire.

It is generally believed that foams based purely on hydrocarbon surfactants cannot give a negative spreading energy on a hydrocarbon fuel. We have found, surprisingly, that compositions according to the invention can form films on aviation fuel, or Avtur.

The composition having the formulation above (called 'A') was sprayed on to Jet A1 fuel. For comparison, two different prior art fluorine-free fire fighting foaming compositions (B and C), not in accordance with the subject matter claimed herein, were each tested separately on Jet A1 fuel under identical conditions (20° C.). The composition 'A' of the invention was also tested at 30° C. The results are shown below in Table 6.

TABLE 6

| Example | Water surface tension yw, mN/m | Water/fuel interfacial tension yf/w, mN/m | Fuel surface tension yf, mN/m | Spreading coefficient = yw + yf/w − yf, mN/m | Temp ° C. |
|---|---|---|---|---|---|
| A | 24.0 | 0.2 | 28 | −3.8 | 20 |
| B | 27.7 | 4 | 28 | +3.7 | 20 |
| C | 29.4 | 4 | 28 | +5.4 | 20 |
| A | 24.0 | 0.2 | 24.5 | −0.3 | 30 |

Surface and interfacial tensions were measured using a White 'OS' Type torsion balance with a 1 cm diameter platinum du Noüy ring.

The prior art formulations B and C both had positive spreading coefficients on Jet A1 fuel and, so, neither was able to form an aqueous film on the surface of the fuel. Composition A (of the invention), however, has a negative spreading coefficient and forms a film at both 20° C. and 30° C.

The invention claimed is:

1. A fire fighting foaming composition comprising a first surfactant selected from alkyl group-containing amphoteric surfactants wherein the amphoteric surfactants are selected from betaines, sulphobetaines and hydroxysultaines and wherein the alkyl group contains at least 8 carbon atoms, and alkyl group-containing zwitterionic surfactants, wherein the alkyl group contains at least 8 carbon atoms, and mixtures thereof, and a second surfactant selected from alkyl sulphates, alkyl phosphates, dialkylsulphosuccinates, alkyl carboxylates and mixtures thereof, wherein the alkyl group contains at least 8 carbon atoms, and wherein the weight ratio of the first surfactant to the second surfactant is in the range of from 3:1 to 1:1.5, and wherein the said fire fighting foaming composition is essentially free of fluorine, and does not contain any polysaccharides, wherein said fire fighting foaming composition further comprises a water-miscible solvent that is 2-(2-butoxyethoxy) ethanol.

2. A composition according to claim 1, wherein the first surfactant is selected from alkyl amine oxides, betaines and mixtures thereof.

3. A composition according to claim 2, wherein the first surfactant is an alkyl amine oxide wherein the alkyl group contains 10 or more carbon atoms.

4. A composition according to claim 1, wherein the second surfactant is an alkyl sulphate wherein the alkyl group contains 10 or more carbon atoms.

5. A composition according to claim 4, wherein the alkyl sulphate is a water-soluble alkyl sulphate, wherein the water-soluble alkyl sulphate is an ammonium salt, alkali metal salt or alkaline earth metal salt.

6. A composition according to claim 5, wherein the water-soluble alkyl sulphate is an ammonium salt or a sodium salt.

7. A composition according to claim 1, wherein the weight ratio of first surfactant to second surfactant in the composition is in the range of from 2.5:1 to 1:1.2.

8. A composition according to claim 7, wherein the weight ratio of first surfactant to second surfactant is in the range of from 2.2:1 to 1:1.2.

9. A composition according to claim 8 comprising, as first surfactant, an alkyl amine oxide and, as second surfactant, an alkyl sulphate, wherein the weight ratio of alkyl amine oxide to alkyl sulphate is about 2:1.

10. A composition according to claim 8 comprising, as first surfactant, an alkyl amine oxide and, as second surfactant, an alkyl sulphate, wherein the weight ratio of alkyl amine oxide to alkyl sulphate is about 1:1.

11. A composition according to claim 1, wherein the first surfactant is dimethyl dodecyl amine oxide.

12. A composition according to claim 1, wherein the second surfactant is dodecyl sulphate sodium salt.

13. A composition according to claim 1, wherein water is present in the composition in an amount of from 22 to 88% (w/w).

14. A composition according to claim 13, wherein the solvent is present in the composition in an amount of from 5 to 30% (w/w).

15. A composition according to claim 1, comprising dodecylsulphate sodium salt about 24% (w/w) dimethyl dodecyl amine oxide about 24% (w/w) and about 30% (w/w) of the solvent.

16. A composition according to claim 1, comprising dodecylsulphate sodium salt about 8% (w/w) dimethyl dodecyl amine oxide about 8% (w/w) and about 10% (w/w) of the solvent.

17. A composition according to claim 1, comprising dodecylsulphate sodium salt about 4% (w/w) dimethyl dodecyl amine oxide about 4% (w/w) and about 5% (w/w) of the solvent.

18. A composition according to claim 1, comprising dodecylsulphate sodium salt about 16% (w/w) dimethyl dodecyl amine oxide about 32% (w/w) and about 30% (w/w) of the solvent.

19. A composition according to claim 1, comprising dodecylsulphate sodium salt about 5.3% (w/w) dimethyl dodecyl amine oxide about 10.7% (w/w) and about 10% (w/w) of the solvent.

20. A composition according to claim 1, comprising dodecylsulphate sodium salt about 2.7% (w/w) dimethyl dodecyl amine oxide about 5.3% (w/w) and about 5% (w/w) of the solvent.

21. A composition according to claim 1, which additionally comprises one or more additives selected from corrosion inhibitors, divalent metal salts, buffers, stabilisers, anti-freeze agents and thickening agents, wherein thickening agents are ones that do not contain polymerised sugars or polysaccharide gums.

22. A composition according to claim 21, which comprises one or more corrosion inhibitor.

23. The use of a composition according to claim 1 in preparing a composition for application to a fire.

* * * * *